US006027440A

United States Patent [19]

Roth

[11] Patent Number: 6,027,440

[45] Date of Patent: Feb. 22, 2000

[54] PNEUMATIC SHEET MATERIAL HOLD DOWN CONVEYOR SYSTEM

[75] Inventor: Curtis A. Roth, Post Falls, Id.

[73] Assignee: Thermoguard Equipment, Inc., Spokane, Wash.

[21] Appl. No.: 08/911,468

[22] Filed: Aug. 14, 1997

[51] Int. Cl.[7] ..... B31B 1/42

[52] U.S. Cl. ..... 493/436

[58] Field of Search ..... 493/178, 179, 493/182, 417, 438, 436, 450, 455, 456; 271/196, 197

[56] References Cited

U.S. PATENT DOCUMENTS

| | | | |
|---|---|---|---|
| 1,836,226 | 12/1931 | Craig | 493/179 X |
| 2,785,609 | 3/1957 | Billeb | 493/438 X |
| 3,240,130 | 3/1966 | Neff | 493/438 X |
| 3,564,738 | 2/1971 | Batzdorff et al. | 38/143 |
| 3,797,371 | 3/1974 | Randle | 493/438 X |
| 3,992,982 | 11/1976 | Huiskes | 493/438 X |
| 4,148,476 | 4/1979 | Brekell | 271/196 X |
| 4,614,512 | 9/1986 | Capdeboscq | 493/179 X |
| 4,662,622 | 5/1987 | Wimmer et al. | 271/196 X |
| 4,708,332 | 11/1987 | Bosemann | 493/450 X |
| 5,094,658 | 3/1992 | Smithe et al. | 493/438 X |
| 5,461,467 | 10/1995 | Malachowski | 271/197 X |

FOREIGN PATENT DOCUMENTS

| | | | |
|---|---|---|---|
| 406087176 | 3/1994 | Japan | 493/450 |
| 1746996 | 7/1992 | Russian Federation | 493/450 |

*Primary Examiner*—David A. Scherbel
*Assistant Examiner*—Anthony Ojini
*Attorney, Agent, or Firm*—Wells, St. John, Roberts, Gregory & Matkin P.S.

[57] ABSTRACT

A pneumatic sheet material hold-down conveyor system is described in which a frame mounts conveyor having a movable working flight. A first manifold with a support surface movably supports the working flight. Air intake openings are formed through the support surface, connected to a vacuum source for producing suction against the sheet material to draw the sheet material against the working flight. A second manifold is also provided on the frame, with a discharge surface extending along and in spaced relation to the working flight. Air discharge openings formed through the discharge surface is directed toward the working flight. A positive air pressure source is connected to the second manifold and is configured to pressurize the second manifold such that pressurized air is delivered through the air discharge openings toward the working flight and against the sheet material to push the sheet material against the working flight. A flat sheet positioned on the working flight between the first and second manifolds is thereby held against the working flight by positive air pressure on one side and negative air pressure on an opposite side. Thus secured, the sheet material may be moved by the working flight and be folded by the forming mandrel. A forming mandrel is provided on the frame and extends along the working flight to engage and progressively fold sheet material moving along the working flight.

18 Claims, 6 Drawing Sheets

PNEUMATIC SHEET MATERIAL HOLD DOWN CONVEYOR SYSTEM

TECHNICAL FIELD

The present invention relates to conveying of sheet material and particularly to conveying sheet material while using air pressure to hold the sheet material while being transported by a conveyor working flight.

BACKGROUND OF THE INVENTION

Sheet material such as corrugated stock is typically discharged single file and along a plane from a finishing machine in which the sheets are printed, die cut, creased, perforated or otherwise treated by the finishing machine. The sheets may be rectangular or of other die cut configurations, but are typically flat and unfolded when leaving the finishing machine. Other processes downstream of the finishing machine discharge are used to form the sheet material into desired configurations. One such configuration is a flat partially folded box shape, the folding process of which being exemplified in FIG. 1 of the drawings.

A problem has been experienced in transporting single sheets of sheet material such as corrugated box stock, downstream of finishing machines. The individual sheets may be of various sizes and configurations, and are typically quite light weight. A conveyor with lugs for engaging trailing edges of sheet materials is typically inadequate for sheet material handling for at least three reasons.

Firstly, the variety of sizes and shapes of sheet material being discharged from the finishing machine dictates that the conveyor lugs be adjustable. Adjustable lugs on conveyor belts are not practical.

Secondly, there is a high probability that the engaged edges of the sheets would be damaged by engagement with the lugs. Damaged sheet material is not acceptable.

Third, a conveyor lug engaging only the trailing edges of individual sheets does not permit effective control of the sheet during transport. The sheets typically have large surface areas and are light weight, and will often lift up from the conveying surface, especially if the conveyor is operating at speeds matching the production rate of the finishing machine. This creates a sheet handling problem, increases the probability of damage to the sheets, and increases the likelihood of disruption in downstream handling equipment.

Conveyors used without trailing edge engaging lugs would be more desirable, considering there would be no need for adjustments for sheet size or shape, and no trailing edge damage would be likely. However even rough surface belting is not adequate to assure a firm grip on the sheets and slippage may be expected. Also the sheet materials would still tend to periodically lift from the belt surface.

A solution to the above problems has been to incorporate two belt conveyors with the working flight of one conveyor engaging the underside of the sheet material and the working flight of the other conveyor engaging the top surface of the sheet. While this provides more effective grip without requiring conveyor lugs, and control of the sheet materials is improved, slippage is still possible. Further, the upper belt will often smudge or streak ink applied by the finishing machine.

A need therefor remains for a sheet material conveyor which will provide positive control of the sheet materials, avoid damage to the sheet surfaces and edges, and that will not permit the sheet material to lift up from the conveying surface during transport. The present invention fills these needs, as will be understood from the following description.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
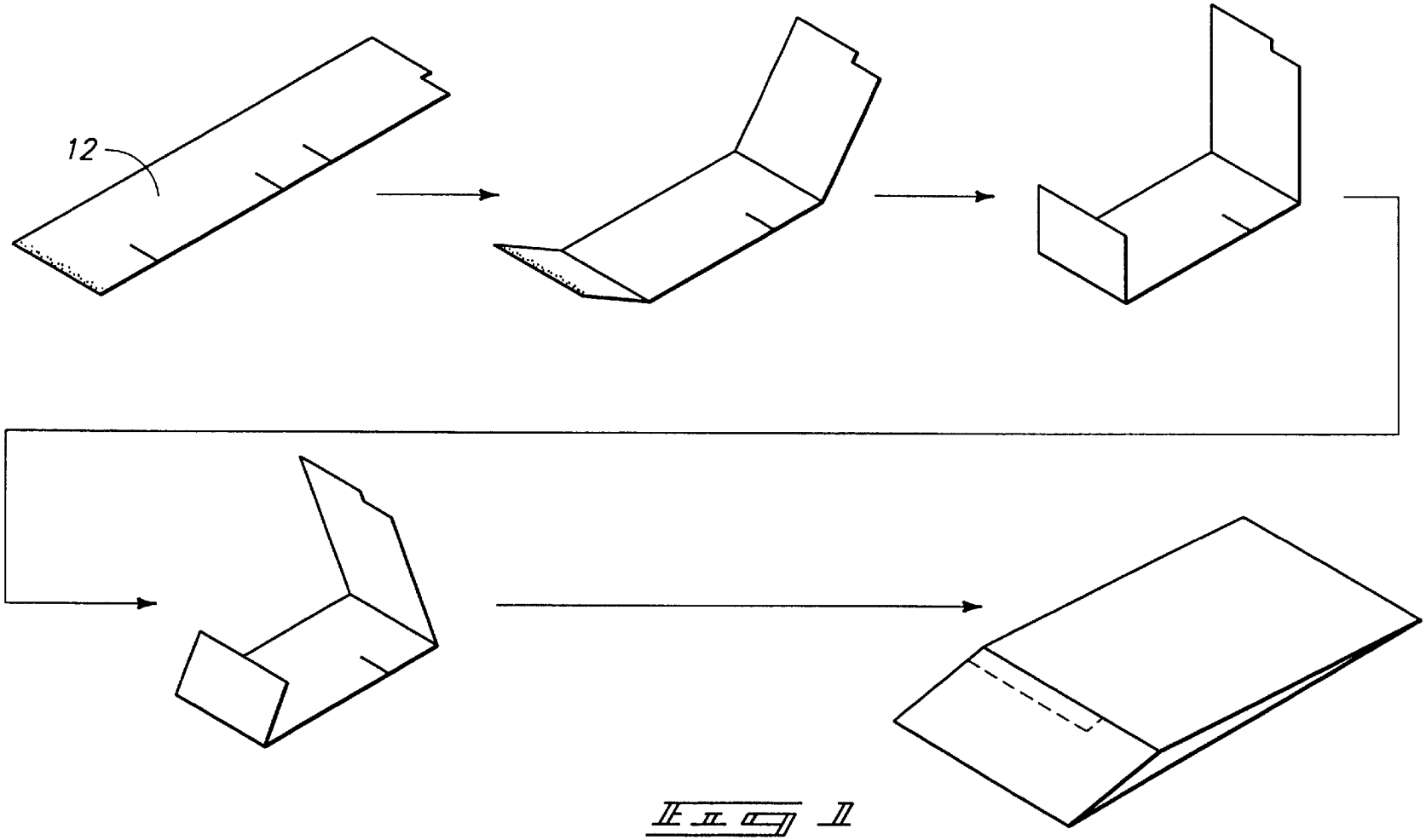
FIG 1 PRIOR ART
FIG. 1 is a sequence view illustrating formation of a box from sheet material.
Figure 2:
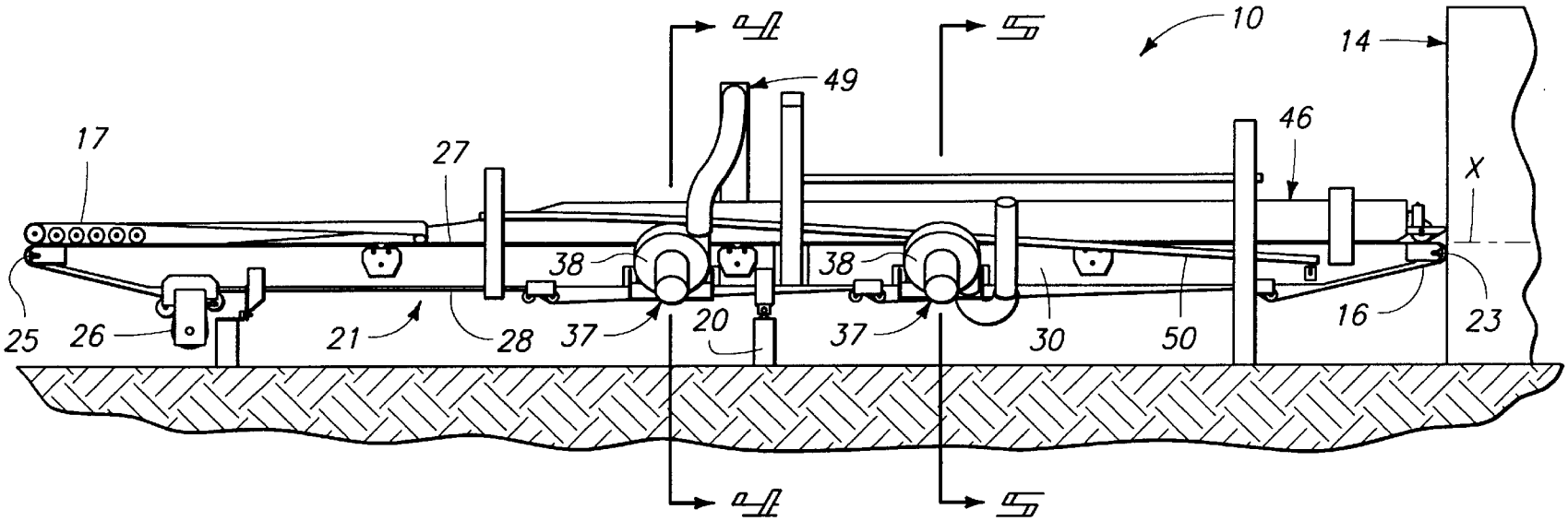
FIG. 2 is a side elevation view of a preferred form of the present pneumatic hold-down conveyor system.
Figure 3:
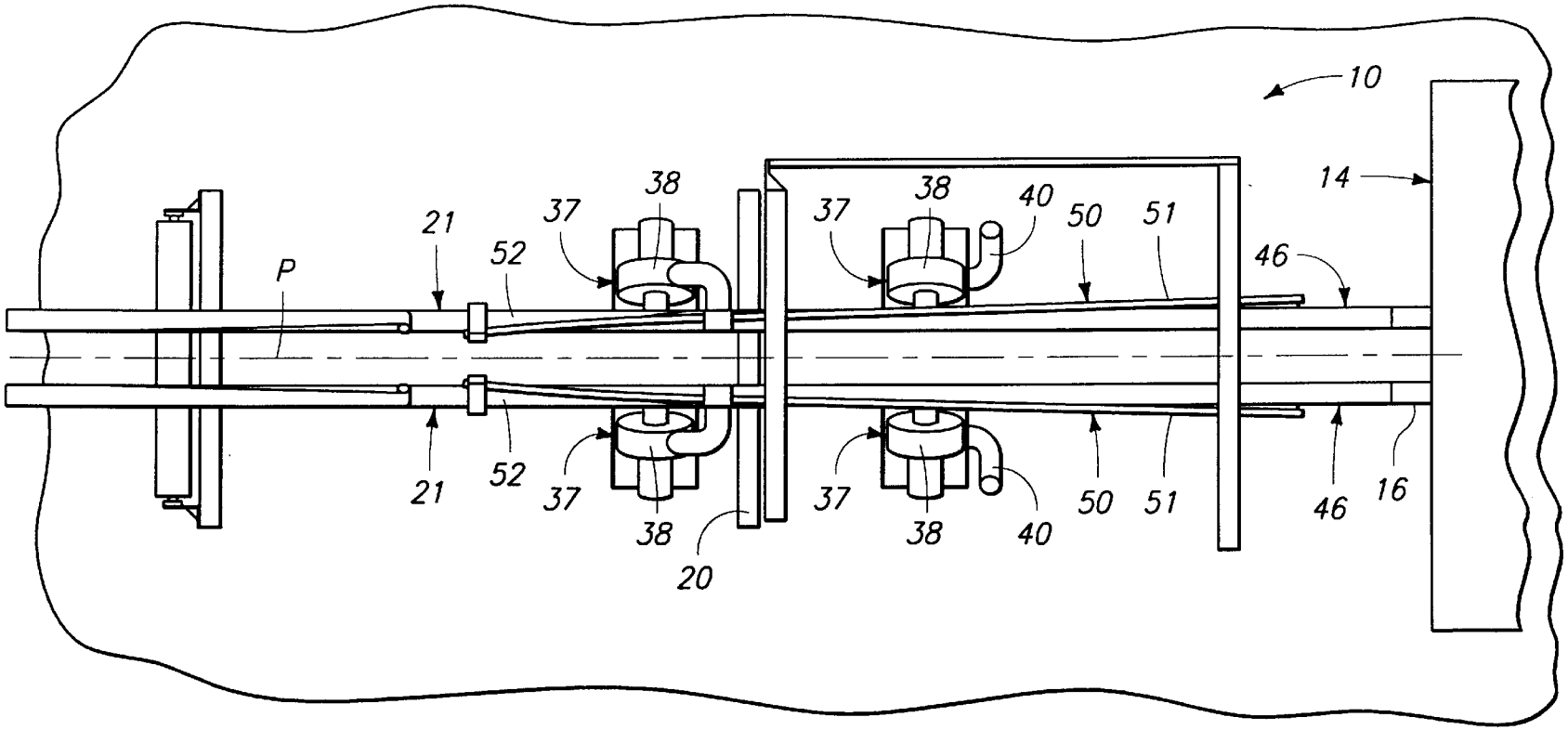
FIG. 3 is a top plan view thereof.

A preferred form of the present pneumatic hold-down conveyor system is generally shown in FIGS. 2 and 3 of the drawings and is generally designated therein by the reference numeral 10. The present conveyor system 10 is intended to function to move flat sheet material 12 (FIG. 1) that may be received from a conventional source such as a finishing machine part of which is indicated in FIG. 2 at 14.

Sheet material which may be provided as a succession of individual sheets formed of corrugated paper is fed in closely spaced relation along a plane "X" from the finishing machine 14. The individual sheets may be formed as they move along the present conveyor system 10 into box configurations as shown in the sequence diagram of FIG. 1. Apparatus for performing this function will be described in greater detail below.

The sheets fed from the finishing machine 14 are received at an infeed end 16 of the present conveyor system 10 and are moved along, preferably in substantially the same plane "X' to a discharge end 17. It is intended that the sheets be moved by conveyor system 10 at the same or faster rate as the sheet discharge rate from the finishing machine 14. Thus the sheets are moved either substantially end-to-end along the conveyor system 10 or in spaced relation, depending upon the selected operational speed as determined by conventional speed control components.

The conveyor system 10 includes a frame 20 that supports the infeed end 16 at the elevation of the finishing machine discharge. Appropriate adjustment mechanisms may be provided on the frame to enable selective height and width adjustments to accommodate various forms of infeed mechanisms such as the finishing machine exemplified herein.

In a preferred form at least one conveyor including a working flight, most preferably a conveyor belt 21, is provided on the frame 20, extending from the infeed end 16 to the discharge end 17. In the illustrated example, two substantially identical belts 21 are positioned along the frame in parallel relation (FIG. 2). However it should be understood that as few as one belt could be used. Alternatively, more than the two commonly driven belts 21 could also be utilized depending upon the nature of the sheet material to be handled and the operations to be performed.

In the example illustrated and described below, the conveyor system includes opposed sides that are substantially mirror images on opposed sides of a bisecting longitudinal vertical plane "P" (FIG. 3). To avoid prolixity, only one side of the system will be described, it being understood that the matching components on the opposite side are substantially identical and mirror images of the components described.

The belt conveyor 21 is trained about an infeed roll 23 at the infeed end 16 of conveyor system 10, and a discharge roll 25 is situated at the conveyor discharge end 17. The rolls 23, 25 define a course for the endless belt including a working flight 27, and a return flight 28. The belt is driven by means of a conventional conveyor belt drive 26 (FIG. 2). (Note it is preferred that the belt 21 on the opposite side of the system is also driven by the same belt drive.).

Figure 8:
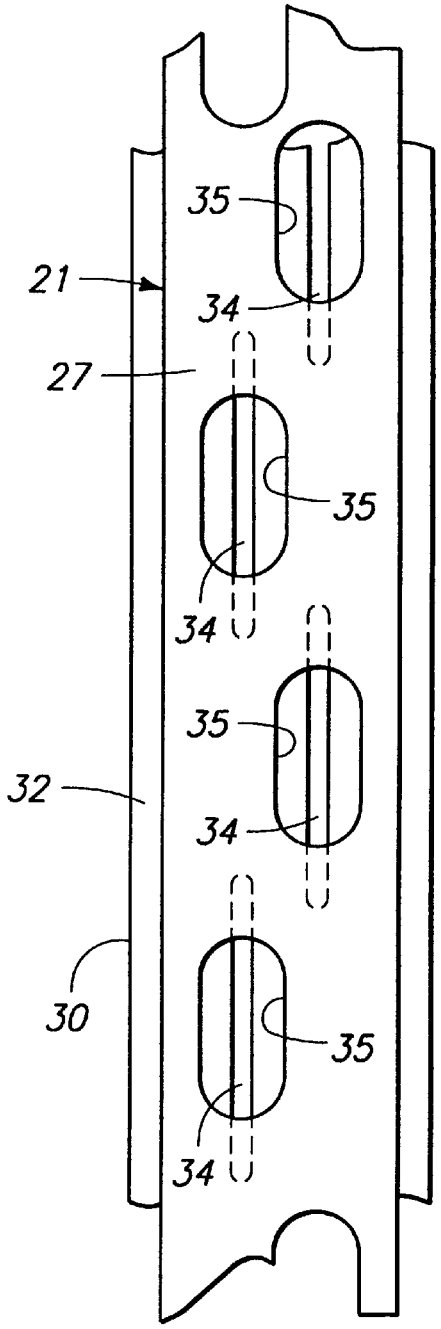
FIG. 8 is a fragmented detail view taken substantially along line 8—8 in FIG. 6.

The working flight 27 is movably supported along an elongated first manifold 30, which includes a flat support surface 32. Air intake openings 34 (FIGS. 6, 8) are formed through the support surface 32 to communicate openly with the manifold interior. The openings 34 are preferably in open communication with holes 35 formed through the belt 21 so air drawn into the manifold 30 must first travel through the holes. A suction force is thus created along the plane of the working flight, used to draw the sheet material firmly against the top surface of the conveyor belt.

A vacuum pressure source 37 is used to produce the suction force through the first manifold 30. In a preferred form, the source 37 is comprised of a blower 38 in which the intake is connected to the manifold. In one application, as illustrated, two blowers 38 are provided on each side of the conveyor system, thus totaling four blowers. Each blower 38 has its intake connected to one of the first manifolds 30.

The presently preferred blowers 38 are of the centrifugal fan type with axial-flow impellers. Centrifugal blowers are preferred since the axial-flow impellers will produce high volume/low pressure output, a feature desirable to attain preferred sheet material hold-down characteristics in the present system 10.

Figure 4:
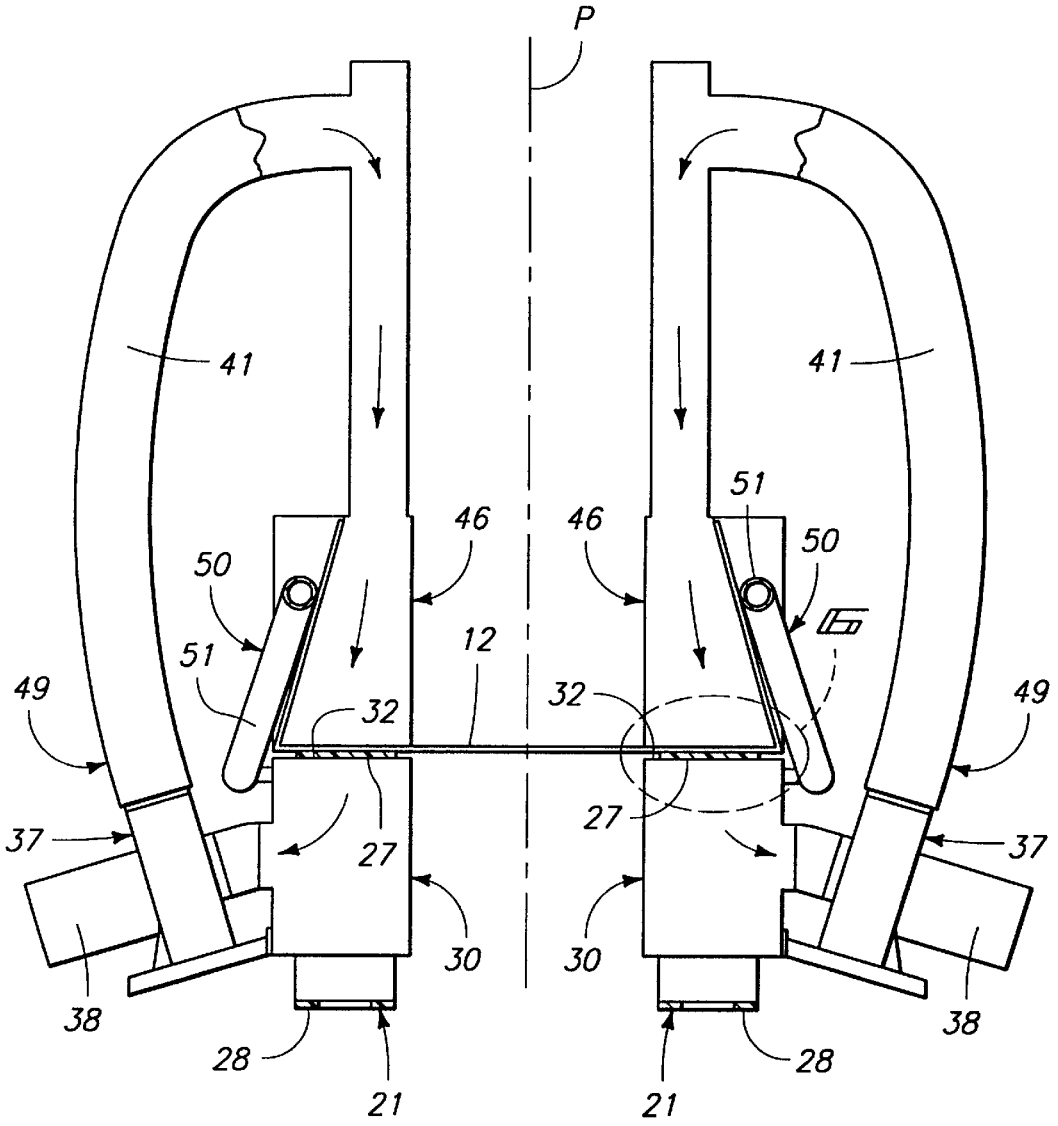
FIG. 4 is an enlarged fragmented sectional view taken substantially along line 4—4 in FIG. 2.
Figure 5:
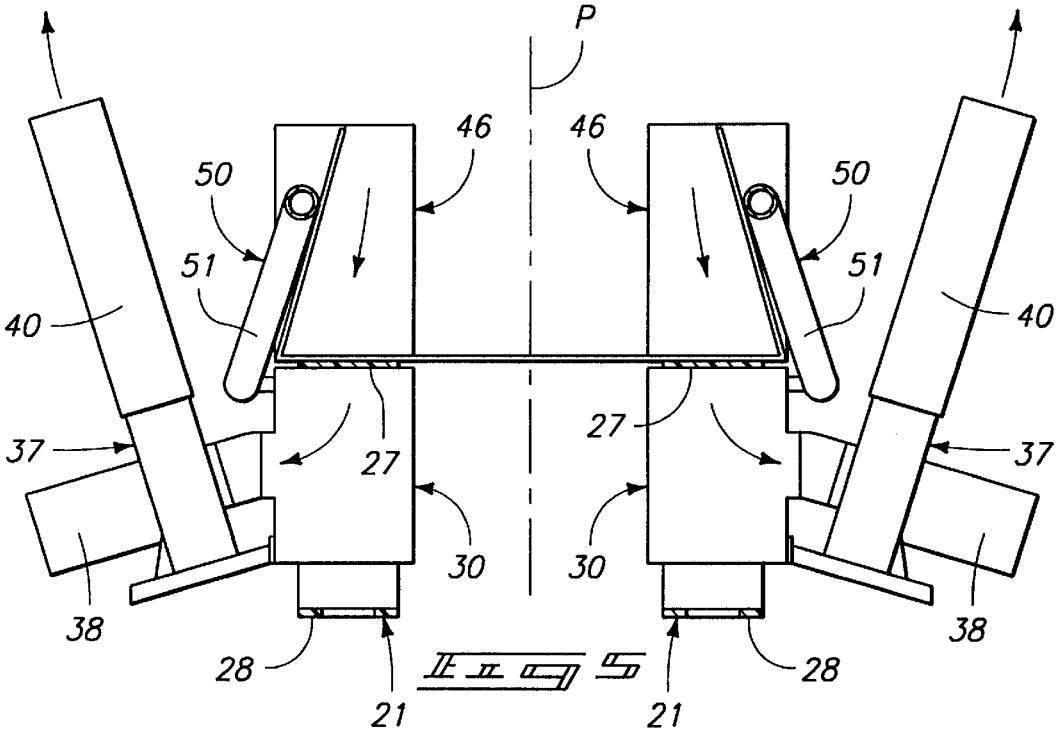
FIG. 5 is an enlarged fragmented sectional view taken substantially along line 5—5 in FIG. 2.

It is also presently preferred that each blower 38 be selected to deliver an unloaded discharge of approximately 2700 cfm (cubic feet per minute). In order to effect sufficient suction force with the blower intakes connected to the first manifolds, two of the four fans have discharges 40 (FIGS. 3, 5) directed to atmosphere, and the remaining two blowers have discharges 41 (FIGS. 3, 4) that are routed back into the system as described below.

Figure 6:
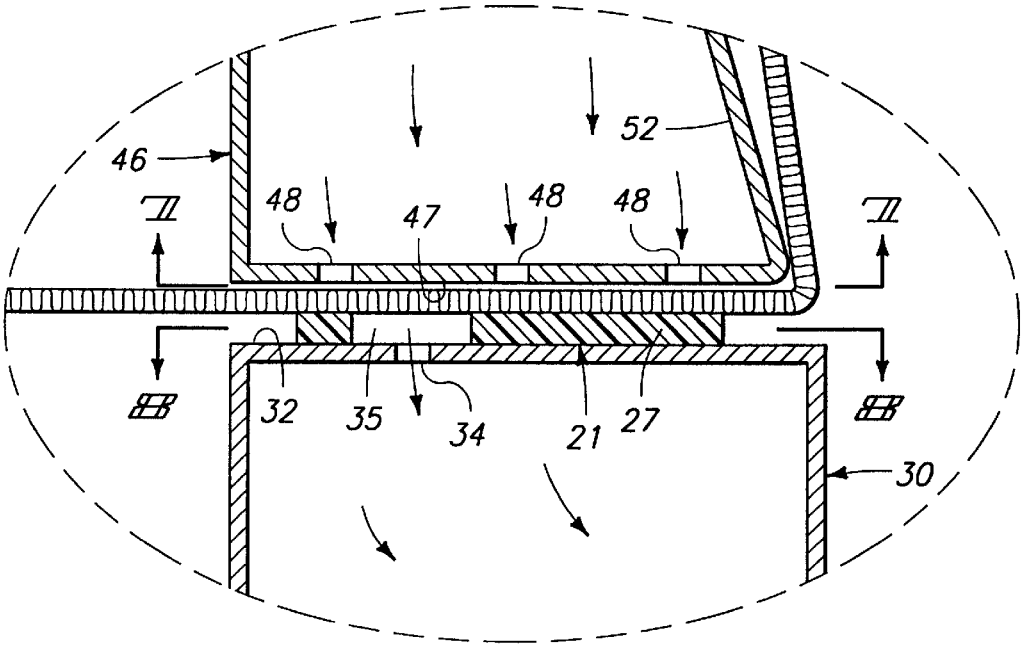
FIG. 6 is an enlarged detail sectional view illustrating an area encircled and labeled 6 in FIG. 4.
Figure 7:
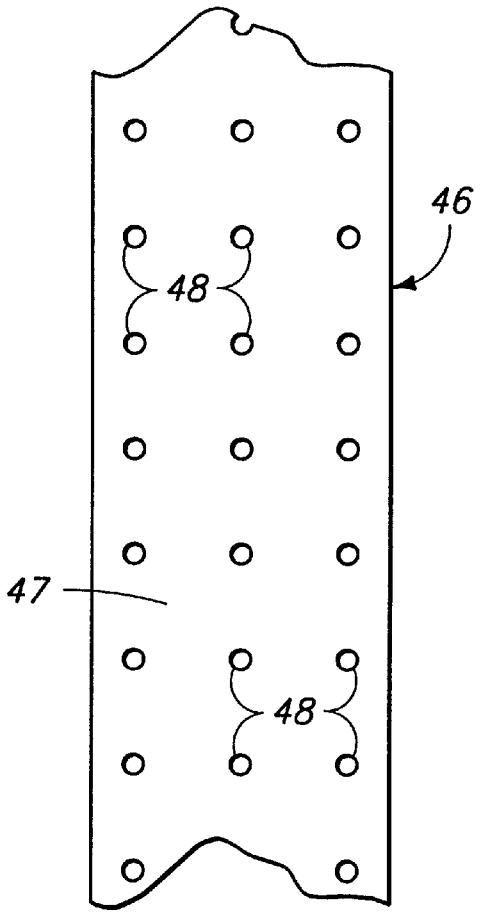
FIG. 7 is a fragmented detail view taken substantially along line 7—7 in FIG. 6.

The preferred system includes a second manifold 46 on the frame 20 having a discharge surface 47 extending along and in spaced relation to the working flight 27. The preferred surface 47 is flat and parallel to the working flight 27 (FIG. 6). Further, the surface 47 is spaced from the working flight by a distance slightly greater than the thickness dimension of the sheet material (between opposed areal surfaces). Thus a sheet material receiving space is provided between the surface 47 and the working flight 27 for reception of the sheet material. One surface of the sheet will ride directly on the working flight 27, and the opposed surface will be slightly spaced (leaving an air space) from the surface 47.

The discharge surface is provided with spaced air discharge openings 48 that are directed into the sheet material receiving space and toward the working flight 27. The openings 48 are substantially equally spaced apart from one another along the length of the second manifold 46. In a preferred form, the openings 48 are 0.125 inches in diameter and are spaced at 2.0 inch intervals longitudinally and transversely along the length of the manifold 46.

A positive air pressure source 49 is connected to the second manifold 46, configured to deliver pressurized air through the air discharge openings 48 toward the working flight 27 to push the sheet material against the working flight 27. In a preferred form, the positive air pressure source 49 includes the discharges 41 of the blowers 38. Thus the same blowers may find double use, first as the vacuum source 37 and secondly as the pressure source 49. It is noted though, that only two of the four blowers have their discharges connected to the second manifolds.

In a preferred form, a forming mandrel 50 is provided on the frame (on each side of the frame). The preferred mandrel 50 is comprised of an elongated bar 51 extending from the infeed end 16 along the first and second manifolds and working flight 27. The bar 51 is shaped in an elongated curved configuration to engage and progressively fold sheet material moving along the working flights 27. As shown, the mandrel 50 first engages the sheet material, then lifts the engaged part upwardly.

The second manifold includes a sheet forming surface 52 formed in an elongated curve along the working flight. The curvature of the bar 51 matches the curvature of the sheet forming surface 52 (FIG. 6) but is spaced from the forming surface to receive parts of the sheet material. The bar 51 and forming surface 52 cooperate to progressively fold engaged parts of the sheet material into a desired configuration (such as shown in FIG. 1) as the material is moved along the working flight 27.

It is pointed out that if used, the mandrels and forming surfaces could be formed in configurations other than as exemplified. For example the mandrel bars could curve downwardly and the forming surfaces could be provided on the first manifolds. This configuration could then function to progressively fold parts of the sheet material downwardly instead of upwardly as shown. Still further, other mandrels could be included to perform other folding or forming procedures.

OPERATION AND PROCESS

The presently preferred process for conveying sheet material and operation of the present system may be easily understood with reference to the foregoing description.

Before initiating operation, the conveyor drive 26 is activated to move the belt 21 continuously about the course defined by rolls 23, 25. The rotation is controlled such that the working flight 27 will move continuously from the infeed end 16 toward the discharge end 17. The blowers 38 are also activated.

In operation, the blowers 38 will function to produce a downward suction force through the working flight 27 (by way of the spaced holes 35 sliding past the intake openings 34 in the first manifold 30). At the same time, positive pressure airflow is directed through the blower discharges 41 and through openings 48 in the second manifolds 46. Thus air is being: (a) drawn downwardly from the surface of the working flight; and (b) pushed downwardly through the discharge surface of the second manifold toward the working flight 27.

Now sheet material may be fed into the infeed end 16 of the conveyor system along the conveyor working flight 27. This step is accomplished in the illustrated arrangement by positioning the infeed end 16 adjacent to the discharge part of the finishing machine 14. In situations where the present system is to be used downstream of a finishing machine, sheets will be automatically fed from the finishing machine and into the space between the working flight and discharge surface of the second manifold.

Suction is applied to the sheet material to pull the sheet material against the working flight 27. This is accomplished by operation of the vacuum source 37, pulling air downwardly through the holes 35 in the working flight, and the air intake openings 34 in the first manifold 30.

The step of applying a positive air pressure against the sheet material is also performed, to push the sheet against the movable working flight. This is accomplished by the positive air pressure source 49, which receive pressurized air through the discharges 41 of the blowers 38. The air discharge openings 48 direct air against the sheet material, pushing it against the working flight 27, but allowing the working flight to easily move the sheet material along. The adjacent surface of the sheet material never touches the discharge surface 47.

The step of moving the working flight and sheet material while maintaining the suction and positive air pressure against the sheet to hold the sheet on the working flight is accomplished simply by operation of the conveyor drive. The sheet material, held by suction and pressed by positive air pressure against the working flight will move only as the working flight moves. No additional engagement (such as overhead wheels, belts, or lugs) need be provided other than the surface of the working flight to assure such movement. Further, the pressurized air, blowing against the sheet material will not smear or mar the adjacent surface of the sheet material and in fact may be of assistance in drying ink that may have been applied to the sheet material by the finishing machine.

The further step of progressively folding a portion of the sheet may be performed as the sheet is moved along by the working flight 27. This step is accomplished by operation of the bar 51 and forming surface 52. These relatively stationary elements progressively fold engaged parts of the moving sheet material into the desired configuration as the material is moved along the working flight 27.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A pneumatic sheet material hold-down conveyor system, comprising:

a frame;

a conveyor including a movable working flight;

a first manifold on the frame having a support surface movably supporting the working flight;

air intake openings formed through the support surface;

a vacuum source connected to the first manifold and configured to draw air through the air intake openings and produce suction along the working flight to draw the sheet material against the working flight;

a second manifold on the frame having a discharge surface extending along and in spaced relation from and substantially parallel to and in substantial alignment with the working flight to form a sheet material receiving space between the discharge surface and working flight, and having air discharge openings formed by said discharge surface and directed into the sheet material receiving space and toward the working flight; and a positive air pressure source connected to the second manifold and configured to deliver pressurized air through the air discharge openings toward the working flight to push the sheet material against the working flight.

2. The pneumatic sheet material hold-down conveyor system of claim 1, wherein the vacuum source is comprised of a blower with an intake and a discharge and wherein the intake is open to the first manifold.

3. The pneumatic sheet material hold-down conveyor system of claim 1, wherein the positive pressure source is comprised of a blower with an intake and a discharge and wherein the discharge is open to the second manifold.

4. The pneumatic sheet material hold-down conveyor system of claim 1, wherein the vacuum source and positive pressure source are comprised of a blower with an intake and a discharge and wherein the intake is open to the first manifold and the discharge is open to the second manifold.

5. The pneumatic sheet material hold-down conveyor system of claim 1, wherein the second manifold includes a sheet forming surface formed in an elongated curve along the working flight.

6. The pneumatic sheet material hold-down conveyor system of claim 1, wherein the working flight is comprised of an endless belt.

7. The pneumatic sheet material hold-down conveyor system of claim 1, wherein the working flight is comprised of an endless belt having apertures formed along the length thereof openly communicating with the first manifold.

8. A pneumatic sheet material hold-down conveyor system, comprising:

a frame;

a conveyor including a movable working flight;

a forming mandrel on the frame and extending along the working flight and configured to engage and progressively fold sheet material moving along the working flight;

a first manifold on the frame having a support surface movably supporting the working flight;

air intake openings formed through the support surface;

a vacuum source connected to the first manifold and configured to produce suction against the sheet material to draw the sheet material against the working flight;

a second manifold on the frame spaced from the forming mandrel and having a substantially flat discharge surface extending along and in spaced relation to the working flight and defining air discharge openings directed toward the working flight;

a positive air pressure source connected to the second manifold and configured to pressurize the second manifold such that pressurized air is delivered through the air discharge openings toward the working flight and against the sheet material to push the sheet material against the working flight;

whereby a flat sheet positioned on the working flight between the first and second manifolds in substantial parallel relation to said substantially flat discharge surface, is held against the working flight by positive air pressure on one side and negative air pressure on an opposite side, to be moved by the working flight along the forming mandrel and be folded by the forming mandrel.

9. The pneumatic sheet material hold-down conveyor system of claim 8, wherein the vacuum source is comprised of a blower with an intake and a discharge and wherein the intake is open to the first manifold.

10. The pneumatic sheet material hold-down conveyor system of claim 8, wherein the positive pressure source is comprised of a blower with an intake and a discharge and wherein the discharge is open to the second manifold.

11. The pneumatic sheet material hold-down conveyor system of claim 8, wherein the vacuum source and positive pressure source are comprised of a blower with an intake and a discharge and wherein the intake is open to the first manifold and the discharge is open to the second manifold.

12. The pneumatic sheet material hold-down conveyor system of claim 8, wherein the second manifold includes a sheet forming surface formed in an elongated curve along the working flight and wherein the mandrel is curved similarly to the curvature of the forming surface of the second manifold and is spaced therefrom to receive the sheet material.

13. The pneumatic sheet material hold-down conveyor system of claim 8, wherein the working flight and the discharge surface are substantially parallel.

14. A process for conveying sheet material, comprising the steps of:

applying the sheet material along a conveyor working flight;

applying suction force through the working flight against one side of the sheet material to pull the sheet material against the working flight;

directing a positive air flow, from air discharge openings formed in a relatively flat discharge surface that is oriented substantially parallel to a side of the sheet material opposite the one side, against said side of the sheet material opposite the one side and toward the working flight, to push the sheet against the working flight; and moving the working flight and sheet material while maintaining the suction and positive air flow against the sheet to hold the sheet on the working flight.

15. The process of claim 14, including the further step of progressively folding a portion of the sheet as the sheet is moved along by the working flight.

16. The process of claim 14, wherein the step of applying suction to the sheet material is accomplished by providing a first manifold along the working flight, providing intake openings through the first manifold along the working flight, and connecting an intake of a blower to the first manifold.

17. The process of claim 14, wherein the step of applying positive air flow against the sheet material is accomplished by providing a second manifold along and spaced from the working flight and providing said discharge surface and air discharge openings on the second manifold directed toward the sheet material and connecting a discharge of a blower to the second manifold.

18. The process of claim 14, wherein the step of applying suction to the sheet material is accomplished by providing a first manifold along the working flight, providing intake openings through the first manifold along the working flight, and connecting an intake of a blower to the first manifold; and wherein the step of applying positive air flow against the sheet material is accomplished by providing the relatively flat discharge surface and said discharge openings in a second manifold positioned along and spaced from the working flight with said discharge surface substantially parallel to the working flight and with said discharge openings directed toward the sheet materials and connecting a discharge of said blower to the second manifold.

* * * * *